United States Patent [19]

Coupland et al.

[11] Patent Number: 4,662,920

[45] Date of Patent: May 5, 1987

[54] CAST COMPONENT OF NICKEL ALLOYS CONTAINING LARGE AMOUNTS OF CHROMIUM

[75] Inventors: Duncan R. Coupland, Burnham; Derek P. A. Pearson, Reading, both of England

[73] Assignee: Johnson Matthey Public Limited Company, London, England

[21] Appl. No.: 670,968

[22] Filed: Nov. 13, 1984

Related U.S. Application Data

[63] Continuation of Ser. No. 363,931, Mar. 31, 1982, abandoned.

[30] Foreign Application Priority Data

Apr. 8, 1981 [GB] United Kingdom ..... 8111047
May 14, 1981 [GB] United Kingdom ..... 8114803

[51] Int. Cl.[4] ..... C03B 37/04

[52] U.S. Cl. ..... 65/15; 148/410; 148/428; 420/443; 420/444

[58] Field of Search ..... 420/444, 443, 584, 585, 420/586, 588; 65/1, 8, 15; 148/410, 419, 428, 442

[56] References Cited

U.S. PATENT DOCUMENTS 4,018,569 4/1977 Chang ..... 75/171
4,061,495 12/1977 Selman et al. ..... 420/444
4,203,747 5/1980 Fezenko ..... 420/585

FOREIGN PATENT DOCUMENTS 1215476 4/1966 Fed. Rep. of Germany .
2530245 1/1976 Fed. Rep. of Germany .
967151 8/1964 United Kingdom .
2033925 5/1980 United Kingdom .

OTHER PUBLICATIONS

Platinum—Enriched Superalloys, Corti et al, Platinum Metals Review, pp. 2–11, vol. 24, No. 1, Jan. 1980.

*Primary Examiner*—R. Dean
*Attorney, Agent, or Firm*—Cushman, Darby & Cushman

[57] ABSTRACT

Nickel alloys comprising less than 25% by volume of $\gamma'$ precipitate and containing 23 to 37% by weight of chromium and in addition a trace to 1.7% carbon, 0.3 to 4% by weight of platinum and/or 0.3 to 8% by weight of ruthenium, a trace to 1.5% by weight titanium and/or a trace to 1.5% aluminium the balance being nickel. The alloys combine improved corrosion resistance with high mechanical strength. Major improvements in mechanical strength seem to be obtained by adding small amounts of titanium and/or aluminium. The alloy is especially suited for use in contact with molten glass for example in a centrifugal spinner.

7 Claims, 2 Drawing Figures

CAST COMPONENT OF NICKEL ALLOYS CONTAINING LARGE AMOUNTS OF CHROMIUM

Figure 1:
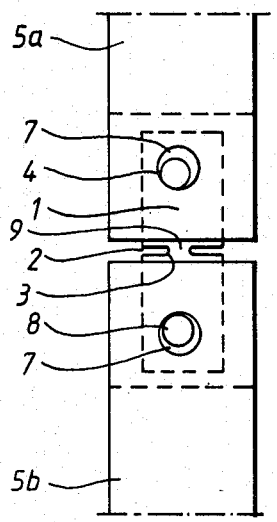

This is a continuation of application Ser. No. 363,931 filed Mar. 31, 1982, abandoned.

This invention relates to nickel alloys containing from 23 to 37% by weight of chromium and which even at temperatures up to about 1100° C. and especially 1000° to 1100° C. combine good resistance to corrosion by glass with good mechanical properties. A demand for such alloys exists in the manufacture of equipment for handling molten glass, especially centrifugal spinners used in making glass fibres.

Nickel superalloys having good corrosion resistance and improved mechanical properties at high temperatures are described in West German patent specification No. 2 530 245, in British patent specification No. 2 033 925 and in the article "Platinum-Enriched Superalloys" by C. W. Corti et al. on pages 2 to 11 of "Platinum Metals Review" Volume 24 No. 1 of Jan. 1980 published by Johnson, Matthey & Co. Ltd. of London. The contents of all three publications are herein incorporated by reference. The superalloys described include chromium and one or more metals chosen from the platinum group and the metal chosen is usually platinum itself. The superalloys comprise mainly two crystalline phases, namely a $\gamma$-matrix and a $\gamma'$-precipitate (i.e. a gamma prime precipitate). The chromium and platinum group metals confer improved corrosion resistance on the alloy. Chromium does this by forming protective surface oxides but the mechanism by which the platinum group metals impart improved corrosion resistance is not understood. The platinum group metals (especially platinum) also appear to stabilise $\gamma'$-precipitate present in the alloy. Strong superalloys contain over 50% by volume of $\gamma'$-precipitate which is largely responsible for the improved mechanical properties of the superalloy at high temperatures.

Although DE No. 2 530 245 envisages superalloys containing as much as 30% by weight of chromium, the presence of large amounts of chromium in the $\gamma$-matrix promotes the formation of an acicular precipitate known as the $\sigma$-phase which harms mechanical properties. Attempts to improve the corrosion resistance of the higher strength platinum-containing nickel superalloys by increasing their chromium contents have resulted in unacceptable losses of mechanical properties because of $\sigma$-precipitation. Therefore such nickel alloys generally contain 23.5% or less by weight of chromium and in practice 8 to 12% is usual.

The problems created by large amounts of chromium in a nickel superalloy containing platinum group metals is aggravated by three further effects. Firstly it has been discovered that the chromium partitions preferentially to the $\gamma$-matrix from the $\gamma'$-precipitate so that any increase in the chromium content of the superalloy as a whole has a disproportionately adverse effect on the $\gamma$-matrix.

Secondly the partitioning of chromium from the $\gamma'$-precipitate to the $\gamma$-matrix leaves the precipitate poorer in chromium and hence less corrosion resistant (although this is partially offset by the presence of platinum group metals).

Thirdly at high temperatures (i.e. above 800° C.) some of the $\gamma'$-precipitate (which is poorer in chromium) re-dissolves in the surface regions of the alloy so making them poorer in chromium (as compared with inner regions of the matrix) and hence less resistant to corrosion. This is particularly undesirable because it is the surface regions which are most exposed to diffusing corrosive agents present in molten glass.

In short the presence of platinum aggravates the problems caused by large amounts of chromium in a nickel superalloy because the platinum increases and stabilises the proportion of $\gamma'$-precipitate in the alloy. When describing a centrifugal spinner for use in making glass fibres at temperatures above 1000° C. in a highly corrosive environment, U.S. Pat. No. 4 203 747 discloses that the spinner is made from a superalloy which does not contain a platinum group metal. The contents of U.S. Pat. No. 4 203 747 are herein incorporated by reference.

An object of the present invention is to provide a nickel alloy containing a large amount of chromium which combines good resistance to corrosion by glass with good mechanical properties at temperatures up to 1100° C. and especially in the range of 1000° to 1100° C. and is accordingly suitable for use in contact with molten glass. Another object is to provide a nickel alloy which is especially suitable for constructing spinners of the type used in convertng molten glass into glass fibre.

Accordingly this invention provides a nickel alloy consisting of 23 to 37% (preferably 26 to 33% by weight of chromium wherein the alloy comprises less than 25% (preferably less then 10%) by volume at room temperature of $\gamma'$-precipitate and additionally comprises (a) a trace to 1.7% (preferably 0.2 to 1.0%) by weight of carbon, (b) 0.3 to 4% by weight of platinum and/or 0.3 to 8% by weight of ruthenium and (c) a trace to 1.5% (preferably 0.3 to 1.5%) by weight of titanium and/or a trace to 1.5% (preferably 0.1 to 1%) by weight aluminum and wherein the balance of the alloy (apart from impurities) is nickel and all the weight percentages are based on the total weight of the alloy. It has been discovered that despite the low proportion of $\gamma'$-precipitate at room temperatures, (which may even be less than 5%), the alloy has good mechanical properties at for example 1080° C. even when in the presence of molten glass. The reason for this is not clear, but it is postulated that the $\gamma$-matrix is strengthened by some as yet unexplained interaction involving the platinum or ruthenium precious metal component. Preferably the precious metal component comprises both platinum and ruthenium which seem to have a synergistic effect on the interaction. It is preferred that the precious metal component consists of 0.3 to 1.7% by weight of the alloy of platinum and 2 to 8% by weight of the alloy of ruthenium. The ratio of ruthenium to platinum is preferably from 12:1 to 3:1 (especially from 7:1 to 3:1) by weight.

The carbon content of the alloy promotes dioxidation during melting and casting operations and in addition it leads to a strengthening of the $\gamma$-matrix by the formation of carbides and hence some of the components of the alloy may exist in carbide form.

Major improvements in the mechanical properties of the alloys appear to result from the presence of titanium and/or aluminum in amounts which do not greatly exceed their solubilities in the alloy at 1080° C. Theoretically their solubilities should not be exceeded but loss of some titanium or aluminum during air-casting of the alloy or the formation of carbides of titanium may make it desirable to exceed these solubilities by an amount of up to 10% (preferably less then 5%) of the solubility. Titanium may also help to fix any nitrogen impurity in which case some of the titanium may exist as the nitride. It may be that small proportions of other components exist as nitrides.

The alloy may be further strengthened by the inclusion of one or more of refractory metals such as tungsten (preferably 2 to 8%), tantalum (preferably 2 to 6%), niobium (preferably trace to 3%) or molybdenum (preferably trace to 6%) which create solid solution strengthening and/or carbide strengthening effects. Preferably the total amount of these refractory metals should not exceed 8% by weight of the alloy because large amounts may cause rapid corrosion. Tantalum and tungsten are preferred. Mechanical properties (for example strength of ductility) can be improved by conventional heat treatments.

Preferably the alloy should contain iron and possibly cobalt which also provide solid solution strengthening to the $\gamma$-matrix. The alloy preferably contains iron in amounts of from 0.005 to 15% (preferably 0.1 to 5% by weight). Cobalt is less preferred being more easily oxidised during melting and casting but if oxidation is not a serious risk it may be used in amounts of preferably from a trace to 10% (especially up to 5%) by weight. The alloy may also contain vanadium in amounts of from 0.05 to 2% (preferably 0.1 to 1%) by weight which forms beneficial carbides.

Preferably one or more of manganese, magnesium, calcium, hafnium, yttrium, scandium, silicon and rare-earth species such as cerium, lanthanum, neodymium, or mischmetal may be added to the alloy to counter-act the presence of oxygen and/or sulpher and consequently some of the metal component of the alloy may exist as oxide or sulphide impurity although some volatile oxides and sulphides may escape during melting and casting. Magnesium and calcium may have other beneficial effects in addition to being deoxidisers. They may for example reduce the harmful effects of certain interstitial compounds. Silicon may also help to promote formation of MC carbides, especially where M is tungsten, one or more of tantalum, niobium or molybdenum. Preferred amounts of each of these components are as follows:

| | |
|---|---|
| Manganese | trace to 2% (preferably to 1.0%) |
| Silicon | trace to 1.0% (preferably to 0.7%) |
| Magnesium | each trace to 0.5 (preferably to 0.15%) |
| Calcium | and possibly may be present wholly or |
| Hafnium | partially as oxide. |
| Yttrium | |
| Scandium | |
| Rare Earths | |

All percentages are by weight based on the weight of the total alloy. It also appears to be beneficial to add oxides of hafnium, yttrium, scandium, rare earths or mischmetal to provide dispersion strengthening and further corrosion resistance.

Preferably the alloy may also comprise boron and/or zirconium which may improve ductility and reduce notch sensitivity. The alloy preferably contains a trace to 0.3 (especially 0.001 to 0.05%) by weight of boron and a trace to 0.6% (preferably 0.1 to 0.4%) by weight of zirconium.

Figure 2:
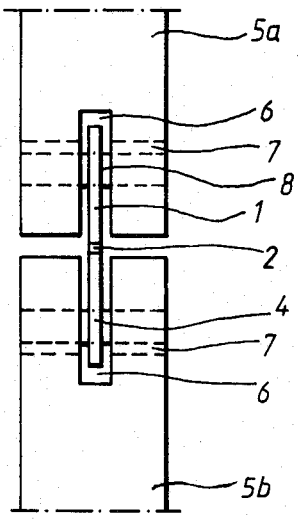

Superalloys can be tested for their mechanical strength in the presence of molten glass at high temperatures by vacuum casting each alloy in turn into a notched bar as shown in FIGS. 1 and 2 of the drawing, packing soda glass into the notch and then testing the bars in a stress rupture machine.

In the drawings,

FIG. 1 is a plan view of a notched bar held by the shackles of a stress rupture machine and FIG. 2 is a side elevation of the bar and shackles shown in FIG. 1

FIG. 1 shows thin bar 1 which is made from a superalloy which is to be tested. Bar 1 is formed with a pair of opposed notches 2 each having a rounded blind end 3. Notches 2 define a neck 9 in bar 1. Bar 1 is also formed with holes 4.

A stress rupture machine (not shown) holds upper and lower shackles 5*a* and 5*b* made from a metal which remains form-stable at 1100° C. As shown in FIG. 2, shackles 5*a* and 5*b* each contain a slit 6 and a hole 7 whose axis crosses slit 6. During testing, bar 1 is held by shackles 5*a* and 5*b* in slits 6 by means of pins 8 which are inserted into holes 4 and 7.

The dimensions of bar 1 are as follows:

Length—4.32 cms
Breadth—1.44 cms
Thickness—0.3 cms
Depth of Notch 2—0.53 cms
Width of Notch 2—0.19 cms The invention is illustrated by the following examples of which Examples A to C are comparative.

EXAMPLES 1 to 6

And Comparative Examples A to G

Various nickel superalloys containing large amounts of chromium and other components as specified in Table A were made up by adding and mixing together the components in a conventional vacuum melting and casting operation. The cast alloys were then used as follows.

Each cast alloy in turn was re-melted in air and investment casted into a notched thin bar as illustrated in the drawings. Powdered soda glass was packed into the notches to provide a highly corrosive environment. The bar was then held in stress rupture shackles 5*a* and 5*b* as illustrated in the drawings and the shackles were loaded to exert a stress of 27.58 MPa (i.e. 4 000 psi) on neck 9. The system is heated in air to 1080° C. and the powdered glass became molten. The times taken for the neck to rupture for two or more samples of each of the alloys tested were noted and the average time for each pair of samples is shown in Tables A and B.

Comparitive Examples A, B and C indicate that the absence of a precious metal component results in mechanical failure after less than 40 hours. The presence of a precious metal component consisting of 6% platinum in Example D increases the lifetime to just over 40 hours. Further small improvement is provided by Example G in which the precious metal component contains both platinum and ruthenium indicating probable synergism between the two. A major improvement is obtained with the addition of small amounts of titanium and aluminum as illustrated by Examples 1 to 6. The alloys of Examples 1 to 6 are capable of easy vacuum casting and should be capable of commercial air casting. They are potentially workable by rolling, forging or extrusion.

Accordingly this invention also provides equipment for handling molten glass, especially a component for a centrifugal spinner when made from a superalloy of the invention.

Usually "trace" is taken to mean not less than 0.001% by weight of the alloy.

Comparative Example H

In order to illustrate the corrosive action of molten glass or nickel alloys containing chromium and platinum, alloy H specified in Table A was tested both in the presence and absence of soda glass by the procedure used in Examples 1 to 6 except the tests were carried out at 1020° C. and 55.16MPa. The presence of glass in the notch reduced the average time to rupture from 243 hours to 79 hours.

TABLE A

| Component | Example A | B | C | D | E | F | G | H |
|---|---|---|---|---|---|---|---|---|
| Ni | B | B | B | B | B | B | B | B |
| Cr | 27 | 29 | 38.6 | 30 | 29 | 30 | 27 | 9.5 |
| Ru | — | — | — | — | 4 | 6 | 5.3 | — |
| Pt | — | — | — | 6 | — | — | 1.1 | 6.7 |
| C | 0.45 | 0.74 | 0.15 | 0.5 | 0.74 | 0.5 | 0.5 | 0.8 |
| Ti | — | — | — | — | — | — | — | 1.7 |
| Al | — | — | — | — | — | — | — | 4.55 |
| W | 5.5 | 7.1 | 2.35 | 3.5 | 6 | 3.5 | 3.5 | 3 |
| Fe | 13 | 8.5 | 2.85 | 0.7 | 7.5 | 0.4 | 0.5 | — |
| Mn | 1 | 0.85 | 1.04 | 0.3 | 0.85 | 0.3 | 0.3 | — |
| Si | — | 0.9 | 1.3 | — | 0.8 | — | 0.64 | — |
| Ni | — | — | — | — | — | — | — | 0.3 |
| Ta | — | — | — | 4 | — | 4 | — | 1.5 |
| Co | — | 0.1 | 37 | — | 0.1 | — | — | 14.5 |
| Mo | — | — | 6 | — | — | — | — | — |
| B | — | — | — | — | — | — | — | 0.14 |
| Zr | — | — | — | 0.25 | — | 0.25 | — | 0.5 |
| Average Time to Rupture Hours | *20 | 39.4 | 31.6 | 44.6 | 46.3 | 69.6 | 100.8 | 79 |

B = Balance
*Approximate

TABLE B

| Component | Example 1 | 2 | 3 | 4 | 5 | 6 |
|---|---|---|---|---|---|---|
| Ni | B | B | B | B | B | B |
| Cr | 30 | 30 | 29.7 | 30 | 27 | 25 |
| Ru | 5 | 5 | 5 | 5.1 | 3 | 5 |
| Pt | 1 | 1 | 1 | 1 | 1 | 1 |
| C | 0.25 | 0.5 | 0.25 | 0.25 | 0.5 | 0.5 |
| Ti | 0.8 | 0.8 | 0.8 | 0.8 | 0.8 | 0.8 |
| Al | 1.0 | 0.5 | 0.5 | 0.5 | 0.5 | 0.5 |
| W | 3.5 | 3.5 | 5.5 | 3.5 | 3.5 | 3.5 |
| Fe | 0.5 | 0.5 | 0.5 | 0.5 | 0.5 | 0.5 |
| Mn | 0.3 | 0.3 | 0.3 | 0.3 | 0.3 | 0.3 |
| Y | 0.1 | 0.1 | 0.1 | 0.1 | 0.1 | 0.1 |
| Ta | 4 | 4 | 2 | 4 | 4 | 4 |
| B | 0.02 | 0.02 | 0.02 | 0.02 | 0.02 | 0.02 |
| Zr | 0.25 | 0.25 | 0.25 | 0.25 | 0.25 | 0.25 |
| Average Time to Rupture Hours | 420 | 475 | 480 | 930 | 1010 | *1240 |

B = Balance
*Single Result

In Tables A and B the amount of alloy component is specified in percent by weight on the total weight of the alloy.

We claim:

1. A cast alloy component for a centrifugal spinner of the kind used in making glass fiber wherein the component is a component which comes into contact with molten glass during manufacture of the glass fiber and the cast alloy is a nickel alloy havig a γ-matrix and containing platinum and/or ruthenium, titanium and aluminum and 23 to 37% by weight of chromium, a trace to 1.7% by weight carbon, balance essentially nickel, said alloy including:

(a) 0.3 to 4% by weight of platinum and/or 0.3 to 8% by weight of ruthenium and (b) a trace to 1.5% by weight of titanium and a trace to 1.0% by weight of aluminum whereby the alloy comprises less than 5% by volume at room temperature of γ'precipitate, said alloy being characterized by its mechanical resistance at a temperature around 1080° C. even when in the presence of molten glass.

2. A cast component according to claim 1 wherein the alloy comprises 0.3 to 1.7% of platinum and 2 to 8% of ruthenium.

3. A cast component as claimed in claim 1 wherein the alloy contains from 0.3 to 1.5% by weight of titanium and from 0.1 to 1% by weight of aluminum.

4. A cast component as claimed in claim 1 wherein the alloy contains at least 40% by weight of nickel and any one or more of the following components in the amounts specified:

| | |
|---|---|
| Tungsten | 2 to 8% |
| Tantalum | 2 to 6% |
| Molybdenum | trace to 6% |
| Niobium | trace to 3% |
| Iron | 0.05 to 15% |
| Vanadium | 0.05 to 2% |
| Cobalt | trace to 0.10% |
| Manganese | trace to 2% |
| Silicon | trace to 1.0% |
| Magnesium | trace to 0.5% |
| Calcium | trace to 0.5% |
| Hafnium and/or oxide | trace to 0.5% |
| Yttrium and/or oxide | trace to 0.5% |
| Scandium and/or oxide | trace to 0.5% |
| Rare Earth or mixture of rare earth species and/or oxide | trace to 0.5% |
| Boron | trace to 0.3% |
| Zirconium | trace to 0.6% |

all the percentages being by weight based on the total weight of the modified alloy.

5. A cast component according to claim 1 wherein the alloy contains the following components in the amounts specified:

| | |
|---|---|
| Tungsten | 2 to 5% |
| Iron | 0.5 to 2% |
| Manganese | trace to 0.6% |
| Yttrium and/or oxide | trace to 0.15% |
| Tantalum | 2 to 6% |
| Boron | 0.001 to 0.3% |
| Zirconium | 0.1 to 0.4% |

all percentages being by weight based on the total weight of the modified alloy.

6. A cast component according to claim 5 wherein the alloy also includes a trace to 1% by weight of silicon.

7. In a centrifugal spinner used for making glass fibres from molten glass and including a component which comes in contact with molten glass, the improvement wherein said component is a component as defined in claim 9 for contact with said molten glass.

* * * * *